US005484178A

United States Patent [19]

Sandhu et al.

[11] Patent Number: 5,484,178

[45] Date of Patent: Jan. 16, 1996

[54] NEW SIDE PULL LATCH MECHANISM

[75] Inventors: Chain S. Sandhu, Farmington Hills; Lev Lilov, Southfield, both of Mich.

[73] Assignee: NYX, Inc., Redford, Mich.

[21] Appl. No.: 218,717

[22] Filed: Mar. 28, 1994

[51] Int. Cl.[6] ..... E05C 1/12

[52] U.S. Cl. ..... 292/173; 292/169; 292/337; 292/DIG. 31

[58] Field of Search ..... 292/165, 336.3, 292/169, 169.11, 173, 175, 140, 145, DIG. 31, DIG. 38, 337, 341.12, DIG. 53, DIG. 64; 70/208, 370

[56] References Cited

U.S. PATENT DOCUMENTS

| | | | |
|---|---|---|---|
| 3,871,198 | 3/1975 | Miller . | |
| 4,023,840 | 5/1977 | Souza et al. . | |
| 4,116,027 | 9/1978 | Tannery . | |
| 4,534,193 | 8/1985 | Takemura et al. . | |
| 4,580,822 | 4/1986 | Fukumoto . | |
| 4,647,091 | 3/1987 | Roubin | 292/DIG. 65 X |
| 4,882,919 | 11/1989 | Craig . | |
| 4,941,696 | 7/1990 | Yamada et al. | 292/341.12 X |
| 5,098,141 | 3/1992 | Bull . | |
| 5,106,134 | 4/1992 | Thau | 292/337 X |
| 5,183,302 | 2/1993 | Pelachyk et al. | 292/336.3 |
| 5,263,346 | 11/1993 | Sato et al. | 292/DIG. 38 X |
| 5,263,750 | 11/1993 | Smith et al. | 292/DIG. 38 X |
| 5,292,159 | 3/1994 | Sandhu et al. | 292/DIG. 38 X |
| 5,297,405 | 3/1994 | Manning et al. | 292/DIG. 38 X |
| 5,350,206 | 9/1994 | Akahori et al. | 292/337 X |

*Primary Examiner*—Rodney M. Lindsey
*Attorney, Agent, or Firm*—Dinnin & Dunn

[57] ABSTRACT

A new latch assembly for a vehicle glove box door, or other locking device, wherein the door is to be held in a flush position relating to an adjoining panel surface. The latch assembly includes a freewheeling locking feature, an actuator member which is not sensitive to the striker positional variance, improved low handle opening effort. The latch assembly also include improved lock cylinder loading, and improved closing efforts by use of a molded urethane bumper. The latch assembly also has improved styling with a single color throughout using no metal parts which need lubrication, and the latch assembly unit is fully enclosed so that no moving parts are visible and the scorpion tail has been not used.

14 Claims, 3 Drawing Sheets

NEW SIDE PULL LATCH MECHANISM

FIELD OF THE INVENTION

The present invention relates generally to a new latch mechanism and more particularly, to a new side pull latch mechanism assembly for an automotive vehicle glove box or the like.

DESCRIPTION OF THE RELATED ART

Glove box latching mechanisms have been used for many years. However, there has been a need for a technically advanced glove box latching mechanism which possesses lower closing and opening efforts, less noise, and an increased area for hand clearance. The desired new latching mechanism should also be economical to produce and possess excellent operative features. Prior art latch mechanisms of this general type have been unsatisfactory, in that the prior mechanisms were expensive to produce, and they did not function properly to assist in preventing noise and distortions from occurring when the glove box was placed in its closed position. Such distortions would occur through flexing and/or movement of the striker bar relative to the glove box door. While attempts have been made in the past to solve such problems, previous latching mechanisms were too costly and did not operate in a satisfactory condition and/or were ineffective.

A prior art latch mechanism by United Technologies, identified as F2AB5406004 on the latch itself, uses a small handle within a small handle area. This gives the latch mechanism higher opening efforts and a less than acceptable ergonomic feel. The latch mechanism also uses a scorpion tail actuator arm which makes it sensitive to the striker position. If the striker position is off then the latch will not completely engage the striker bar which can lead to the glove box door unexpectedly opening. The prior art also further uses only one spring to bias the handle and the actuator arm to their closed and flush positions. The spring is also used to dampen the striker rod when the glove box door is closed. This creates a lot of noise when the glove box door is closed and also deforms the spring which can lead to a complete failure of the actuator and handle. The prior art handle also locked the glove box door by having the lock mechanism come to rest underneath the actuator arm. This would keep the actuator and handle from moving when in the locked position. The loading of the lock cylinder within the latch assembly also created problems with the amount of time needed for assembly and the errors in placing the lock cylinder. Therefore, there is a need for a latch assembly which solves the above-mentioned problems in a cost competitive manner; and that also improves the styling so the color matched handle corresponds and matches with the rest of the glove box assembly.

The state of the art is indicated by the following cited references, U.S. Pat. Nos.: No. 2,600,483 to Pelcin; No. 2,642,300 to Colonna; No. 2,871,048 to Balogh; No. 3,782,141 to Doerfield; No. 4,420,954 to Hieronymi et al.; and No. 4,480,404 to Sato et al.

One object of this invention is to provide a novel latch assembly which is economical to produce and which possesses improved operational features.

Another object of the invention is to provide a novel glove box latching assembly possessing a free-wheeling locking feature.

Another object of the present invention is to provide a new glove box latch assembly which is not sensitive to the striker positional variance, and also has improved opening efforts and closing efforts, and also improved lock cylinder loading.

To achieve the foregoing objects, the new side pull latch assembly is completely made from a plastic material and has no lubricating parts. The latch assembly includes a housing means for holding the lever, actuator and modular means into one compact area. The latch assembly further includes a lever means which has an enlarged area handle. The latch assembly further includes an actuator means which is not sensitive to the striker positional variance. The latch assembly also includes improved lock cylinder loading means which allows for easy one-step insertion of the lock cylinder into the housing means. The latch assembly also includes a modular means which is used to snap onto the back of the housing means in order to hold the camming surface and actuator spring in its proper place in relation to the actuator.

One advantage of the new side pull latch assembly is that it has a free-wheeling locking feature. Another advantage is that it is not sensitive to the striker position variance and also has low opening and closing efforts. A further advantage of the latch assembly is that the lock cylinder loading has been improved. A further advantage of the latch assembly is that the styling has been approved so that the color matched handle matches the glove box and that the entire latch is made from plastic material. Another advantage of the latch assembly is that it is cost competitive and economical to produce.

Other objects, features, and advantages of the present invention will become apparent from the subsequent description and the appended claims taken in conjunction with the accompanying drawings, wherein like numerals indicate like elements.

SUMMARY OF THE INVENTION

Briefly stated, the present invention involves a latch assembly for a vehicle glove box door wherein a door is to be held in a flush position with respect to an adjoining panel surface, said latch assembly comprising, a housing means for the latch assembly; a lever means which operates as a handle and is pivotable on an axis to provide an ability to unlock the latch assembly, said lever means being spring biased to a generally flush position relative to the door and said panel surface; an actuator means which is moveable between at least a first and second position in order to lock or unlock the said lever means, said actuator means including a spring member which biases the actuator means into a locked position, said spring member being enclosed in a circular container within said actuator means; a locking means for locking said actuator means in one position, said locking means having a first and second position; and a modular means which snaps on to said housing means.

BEST MODE OF CARRYING OUT THE INVENTION AND DESCRIPTION OF PREFERRED EMBODIMENTS

Figure 1:
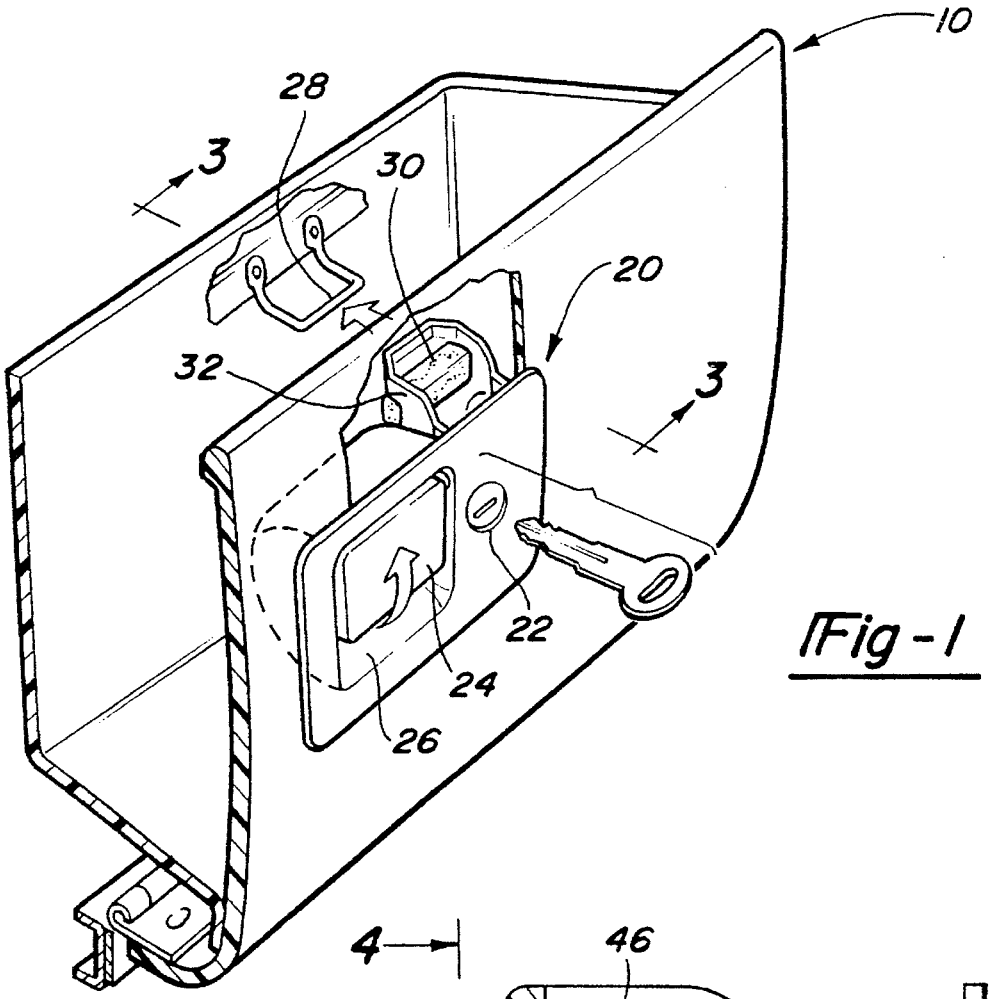
FIG. 1 is a view of the new latch mechanism within a glove box door according to the present invention.
Figure 3:
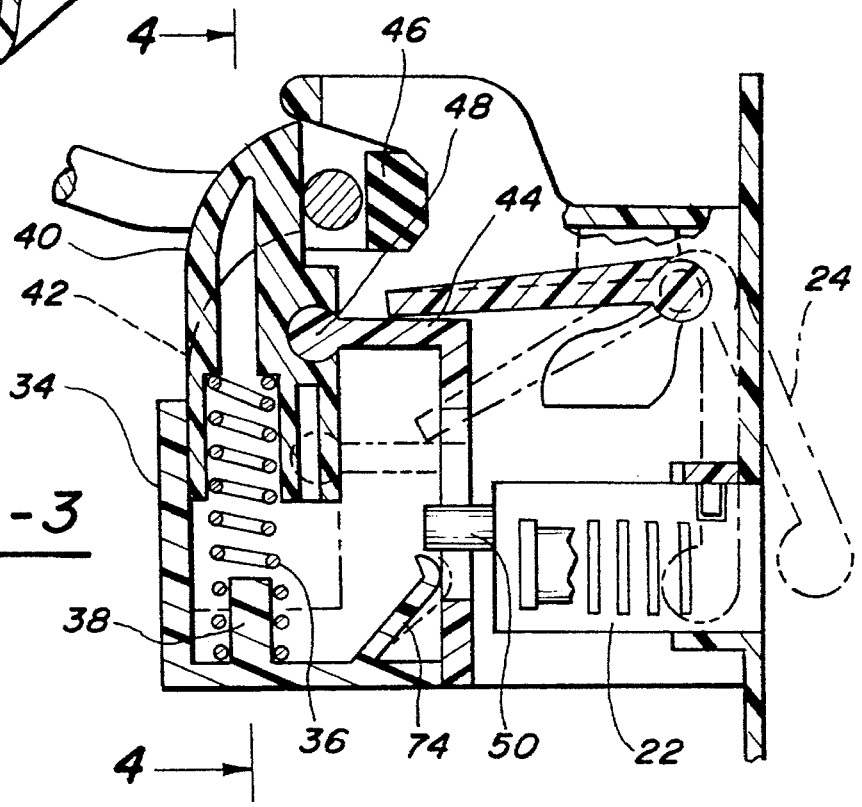
FIG. 3 is a cross-sectional view of the new latch mechanism taken along line 3—3 in FIG. 1.
Figure 2:
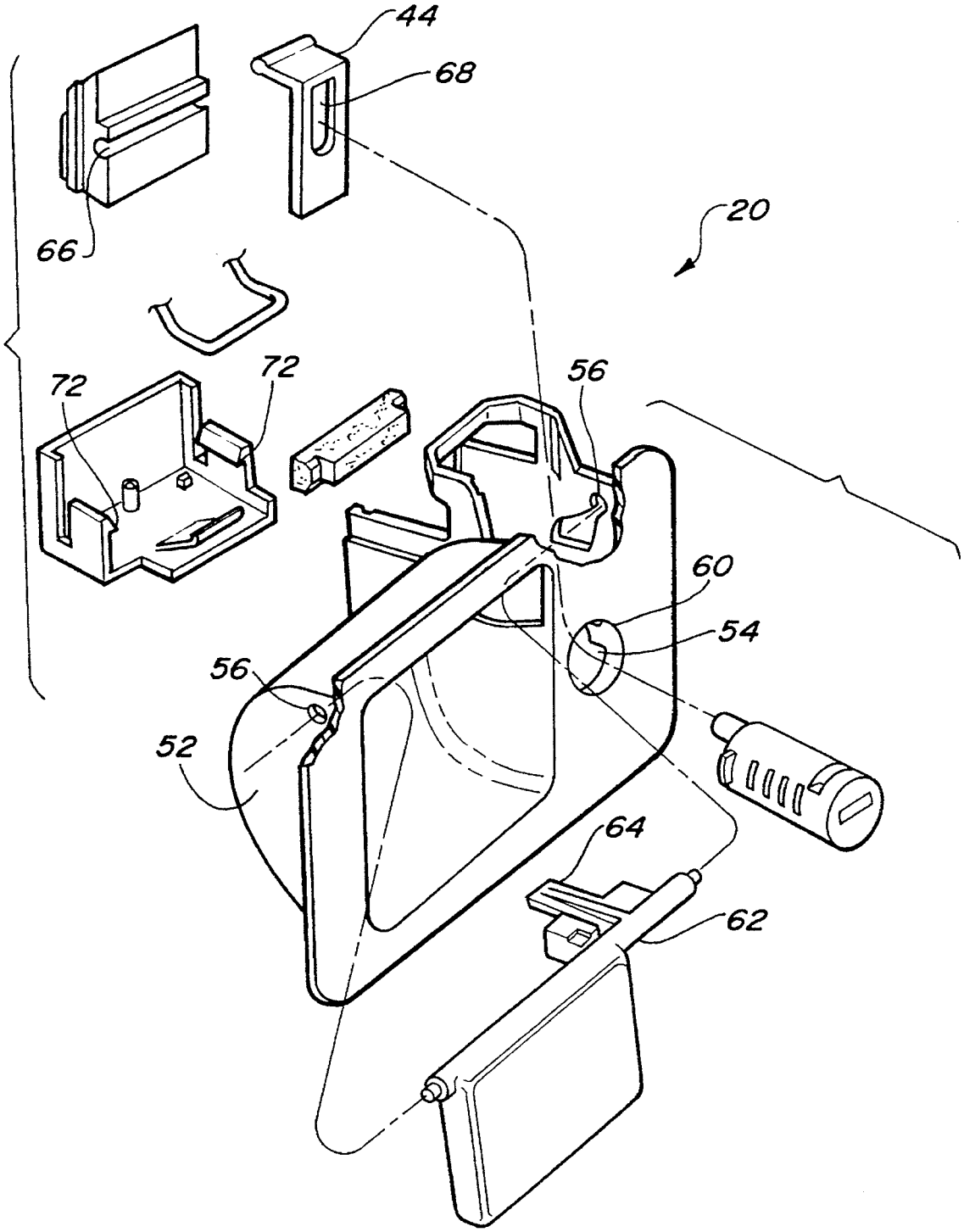
FIG. 2 is an exploded view of the new latch mechanism.
Figure 4:
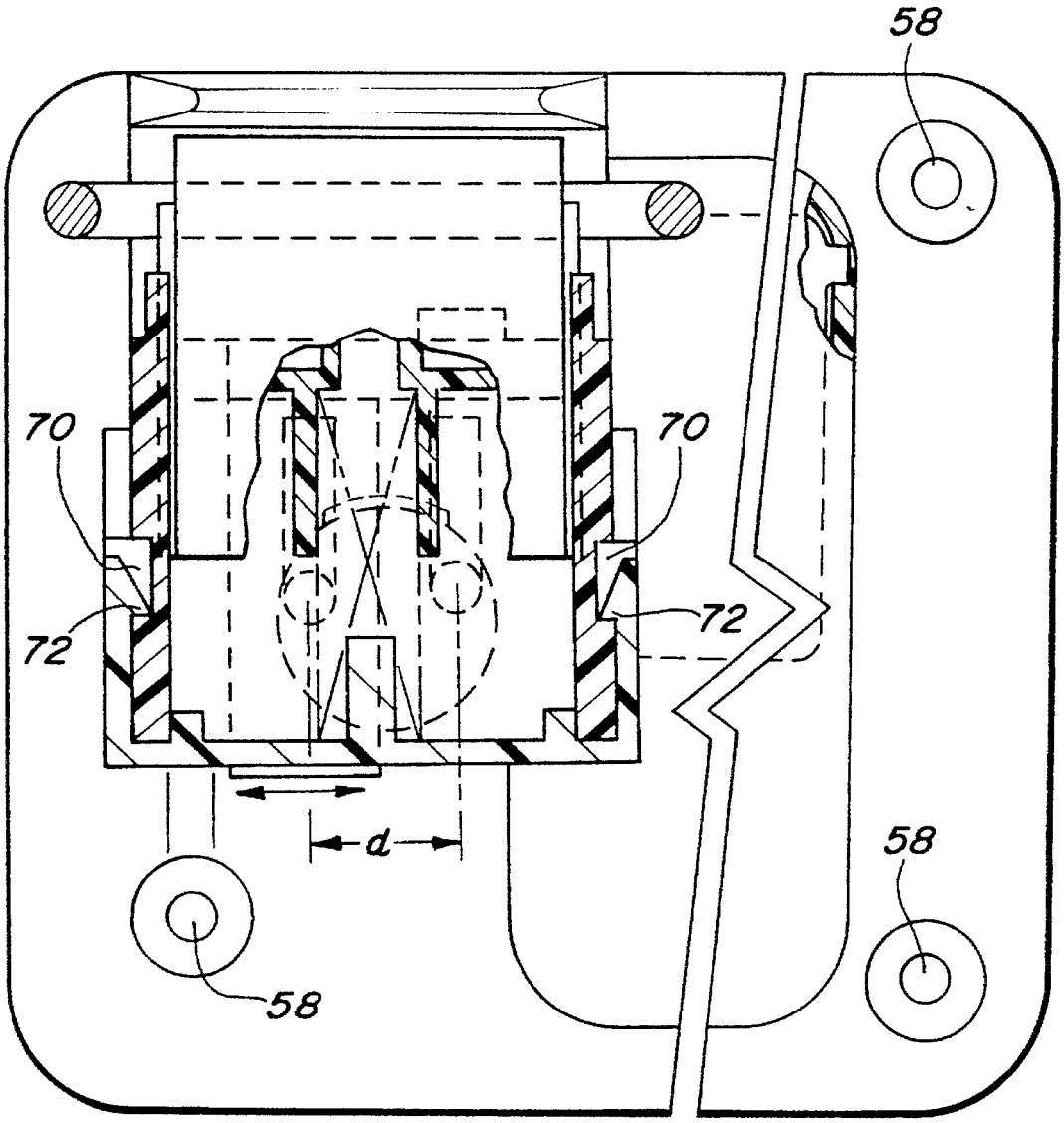
FIG. 4 is a cross-sectional view of the new latch mechanism taken along the line 4—4 in FIG. 3.

Referring now to the drawings, the latch assembly 20 acts to releasably lock the glove box 10 in a position generally flush with the surrounding panel surface such that the edge of the door is in a smooth mating relationship with the door jam and surrounding surface. As shown in FIGS. 2–4 the latch assembly 20 is comprised of a body or housing 52, a pivotable handle member 24, a locking member 22, an actuator member 40, and a modular member 34. The actuator member 40 is spring biased to an upward position by a actuator spring 36 and the handle member 24 is biased by handle a spring to a flush position to the front of the housing member 52 and the glove box door 10.

The housing member 52 includes a large box-like orifice 26 within its front panel. The orifice 26 will allow for more hand clearance when the glove box 10 is to be opened. The housing member 52 also includes a circular orifice 54 within which the locking member 22 is placed. The housing member 52 has receptive apertures 56 which will hold the handle member 24. The housing member 52 also includes an area which will hold the modular member 34. The housing member 52 also includes a striker bar stopper 32 at the top of the housing member 52. The striker bar stopper 32 has a generally U-shaped cavity that a molded rubber bumper 30 may be inserted into in order to lessen the closing efforts and closing noise of the latch assembly 20. Furthermore the housing member 52 includes three circular orifices 58 for connection to the actual glove box front panel.

The housing member 52 has a circumferential orifice 54 which is used to hold the cylinder lock 22 within the housing member 52. The circumferential orifice 54 has a V-channel groove 60 located along its inside edge. This groove 60 allows for easy one-step loading of the lock cylinder 22 within the housing member 52. The V-channel groove 60 on the housing member cylinder area is matched exactly to a V-notch upon the lock cylinder 22 itself. The easy one-step loading occurs by the V-notch of the lock cylinder 22 being matched exactly to the V-groove of the housing member 52. This will assure that the lock assembly 22 is placed in the upright position within the housing member 52. The V-groove 60 reduces the time necessary to assemble the entire latch assembly 20 and also reduces the cost of labor due to the fact that error is less likely in the lock cylinder loading assembly.

The handle member 24 is pivotable on the axle member 62 which has opposed ends. The ends fit within the receptive apertures 56 as found on the housing member 52. The handle member 24 includes the lever arm 64 which co-acts on the camming surface or shoulder 44 of the actuator 40. When the handle 24 is pulled in an outward direction it acts to depress the camming surface 44, which in turn depresses the actuator member 40 and releases the glove box door for opening. The handle member 24 includes a spring along one end thereof so as to replace the handle 24 to a flush position with the glove box door 10 and housing member 52 when not in use. The surface area of the handle 24 has also been enlarged so that the opening efforts of the latch mechanism 20 are less. The larger area for the hand to engage the handle 24 also makes for easier opening and closing efforts of the glove box door 10.

The actuator member 40 has a generally rectangular shape with a rounded corner at one end so as to allow the striker bar 28 to depress the actuator 40 onto the actuator spring 36. The actuator spring 36 is stored within the actuator 40 in a circular container 42 which is used for protection of the spring 36. The actuator spring 36 within the circular container 42 insures that the actuator spring 36 will not be dented or deformed thus avoiding a failure of the actuator member 40 to return to its fully extended position. The actuator spring 36 tends to force the actuator member 40 in a vertical position so that the striker bar 28 will be securely held in a locked position. When the striker bar 28 hits the rounded surface of the actuator member 40 this forces the actuator member 40 in a downward position causing the actuator spring 36 to compress thus allowing the striker bar 28 to snap into place against the vertical straight-edge of the actuator member 40. The actuator member 40 also has a circumferential groove 66 running along the back side of the actuator member 40. The groove 66 is horizontally placed across the actuator member 40.

The camming surface 44 is positioned within the circumferential groove 66 on the back side of the actuator member 40 via the circular knob 48. The camming surface 44 is where the actuator member 40 is physically depressed so that the glove box door 10 may be opened. The handle member 24 has a lever arm 64 protruding out from the handle which when depressed pushes down on the camming surface 44 which is connected to the actuator member 40 and thus forces the actuator member 40 and the actuator spring 36 to compress and release the striker bar 28 from within the actuator members 40 hold. Once the striker bar 28 is passed the actuator member's 40 hold, the actuator spring 36 will then bias the actuator member 40 upward until it is back in its fully extended position. This will then lock the glove box 10 in position until further entry is sought by the user. The camming surface 44 is able to move horizontally along the back side of the actuator member 40 surface so as to allow for locking of the glove box 10.

When the latch mechanism 20 is unlocked the camming surface 44 has been slid to a portion of the groove 66 underneath the lever arm 64 of the handle 24 by the free-wheeling locking mechanism 22. This will enable a person to pull up on the handle 24 which will cause the lever arm 64 connected to the handle 24 to depress the camming surface 44 which in turn will depress the actuator member 40 releasing the striker bar 28 from the hold of the actuator member 40. The actuator member 40 will then be replaced to its fully extended position by the efforts of the actuator spring 36 which is enclosed within a circular container 42 of the actuator member 40. The handle 24 will be replaced to a flush position with the glove box door 10 by the handle spring (not shown) which is connected at the top corner of the handle member 24.

When the latch mechanism 20 is locked the camming surface 44 is slid to a position in the groove 66 away from the lever arm 64 of the handle 24. The camming surface 44 includes a U-shaped orifice 68 vertically within its descending member. The free-wheeling locking mechanism 22 places a protrusion 50 through such orifice 68 and this allows the camming surface 44 to move to the fight or left within the horizontal groove 66 of the actuator member 40. Thus when the glove box door 10 is locked and a person attempts to open the glove box door 10 by pulling up on the handle 24, the lever arm 64 will not come into contact with the camming surface 44. The actuator member 40 will remain in the fully extended position due to the actuator spring member 36 pushing outwardly. The handle 24 will move in an outward position and then return back to a flush position with the glove box door 10 due to the action of the handle spring. The lever arm 64 of the handle 24 does not come into contact with the camming surface 44 but just rotates in an empty space. When the free-wheeling locking mechanism 22 is then placed into the unlocked position the camming surface 44 is slid back underneath the lever arm 64 of the handle 24. Thus when the handle 24 is opened the lever arm 64 of the handle 24 depresses on the camming surface 44 which depresses the actuator member 40 downward until the striker bar 28 is released from the hold of the actuator member 40.

The latch assembly 20 also includes a modular member 34 which is snapped onto the back of the housing member 52. The modular member 34 encloses the actuator member 40 from the back side of the housing member 52. The modular member 34 fits with a snap fit along two grooves 70 on the outer edge of the housing member 52. The modular member 34 includes two inwardly extending edges 72 that will snap fit into the two vertical grooves 70 of the housing member 52. The modular member 34 also includes a circular protrusion 38 on its bottom inside surface which allows for the actuator spring 36 to be placed over the protrusion 38 to securely hold the actuator spring 36 within the actuator spring container 42. The modular member 34 also includes a arm member 74 which holds the camming surface 44 in a vertical position such that the lock mechanism protrusion 22 inserts into the camming surface orifice 68. This will also allow for a surface connection between the lever arm 64 of the handle 24 and the camming surface 44 top portion. The modular member 34 also insures that there will no moving parts visible or any parts open to the air within the latch mechanism assembly 20. The entire latch mechanism assembly 20 is a fully enclosed unit with no exposed moving parts and also no scorpion tail.

The latch assembly 20 also includes a molding bumper 46 which is made of a urethane type material. The molding bumper 46 has a generally rectangular shape. The molding bumper 46 has a inwardly descending edge which is used to lock with two grooves on the housing member 52. The molding bumper 46 is locked via an inner descending edge into the grooves located opposite the striker bar 28 upon the housing member 52. The molding bumper 46 will allow for the striker bar 28 to come into contact with the molding bumper 46 upon closing of the glove box door 10. The molding bumper 46 will allow for soft and noise free closing of the striker bar assembly 28. Previous models of the latching assembly 20 had the striker bar 28 hitting plastic or a spring to stop the striker bar 28. The molding bumper 46 thus will greatly smooth out and soften the impact of the striker bar 28 closing against the housing member 52.

The latch mechanism 20 also is made from all plastic with no parts that need lubrication. The latch mechanism 20 is also made from the same color plastic for all parts including the handle 24, the housing member 52, the locking member 22, and the modular member 34. The use of all the same color plastic and no metal parts makes for error-free construction and lowers the cost necessary to assemble a latch mechanism 20.

Technical Advantages of the Invention

1) The latch mechanism 10 uses a freewheeling locking assembly. The old latch mechanisms would block the plunger of the latch so that the handle would not be pulled. The freewheeling lock will slide the camming surface 44 away from the lever arm 64 so that the handle 24 will still pull open but not depress the camming surface 44 and release the striker bar 28.

2) The latch mechanism 10 is not sensitive to the striker position variance. The actuator member 40 used has a smooth vertical surface which is capable of holding the striker bar 28 at various vertical positions unlike the existing scorpion tail hook design. The new actuator member 40 can compensate for movement of the striker bar 28 while the scorpion tail design could not compensate and thus was prone to unexpected latch failures.

3) The cylinder loading has been improved in the new latch mechanism 10. The cylinder is located on a V-channel groove 60 which is placed within the housing member orifice 54 of the latch assembly 10. The cylinder will be less prone to assembly mistakes and be installed in less time.

4) The opening effort of the latch assembly 10 has also been improved. The low handle opening effort is due to the larger handle 24 and the larger hand access area.

5) The closing effort of the latch assembly has been improved by using a molded bumper 46 made of urethane type material to soften the impact of the striker bar 28 within the latch assembly 10. The old latches would use a spring to stop the striker bar which created a higher closing effort and a lot of noise.

6) The styling and assembly have also been improved on the latch assembly 10. The handle 24 matches the housing 52 in color and is made of a durable Nylon, Zytel material or the like. The housing 52 is made from a reinforced 30% glass filled Polyester, Rynite material or some similar material. It should be noted that the above materials are examples and that other similarly suited materials could be used in place of those listed. The latch assembly 10 is also a fully enclosed unit which has no exposed moving parts.

7) The latch assembly 10 also uses a spring retention pocket 42. The spring retention pocket 42 is an enclosed area where the actuator spring 36 is placed to ensure that it will not deform and be under a controlled compression.

8) Due to the low number of moving parts the new latch mechanism 10 is also very cost competitive. It takes less time and labor in order to construct the new latch assembly 10 which makes it the leader in the automotive industry.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise in as specifically described.

What is claimed is:

1. A latch assembly for a vehicle glove box door wherein a door is to be held in a flush position with respect to an adjoining panel surface, said latch assembly comprising, a housing means for use in placing the latch assembly on the vehicle glove box door;

a lever means which operates as a handle and is pivotable on an axis to provide an ability to unlock the latch assembly, said lever means being spring biased to a generally flush position relative to the door and said panel surface;

an actuator means which is moveable between at least a first and second position in order to lock or unlock the said lever means, said actuator means including a spring member which biases the actuator means into a locked position, said spring member being enclosed in a circular container within said actuator means;

a locking means for locking said actuator means in one position, said locking means having a first and second position, said locking means having a lock cylinder with a V-shaped groove at a predetermined location; and a modular means which snaps on to said housing means for use in securing said actuator means.

2. The latch assembly of claim 1 wherein said modular means has a snap fit device, said modular means also having a circumferential protrusion on an inside bottom surface to hold said actuator spring.

3. The latch assembly of claim 1 wherein said lever means includes a handle, said handle having a predetermined surface area.

4. The latch assembly of claim 1 wherein said actuator means has a vertical linear face for one point connection.

5. The latch assembly of claim 4 wherein said actuator means includes a circular container area for holding said actuator spring.

6. The latch assembly of claim 1 further including a molding bumper placed within said housing means, said molding bumper having a generally rectangular shape and at least one inwardly descending edge.

7. The latch assembly of claim 6 wherein said molding bumper is made of a urethane material.

8. A latch assembly for a vehicle glove box door wherein a door is to be held in flush position with respect to an adjoining panel surface, said latch assembly comprising:

a housing means for use in placing the latch assembly on the glove box door;

a lever means which operates as a handle and is pivotable on an axis to provide an ability to unlock the latch assembly;

an actuator means which is moveable between at least a first and second position in order to lock or unlock the said lever means, said actuator means including a spring member which biases the actuator means into a locked position, said spring member being enclosed in a circular container within said actuator means, said actuator means having an outwardly extending ridge on each side thereof, said ridge having a square-like cross-section, said actuator means having a C-shaped groove and a camming surface, said C-shaped groove being horizontal;

a locking means for locking said actuator means in one position, said locking means having a protrusion for sliding said camming surface within said C-shaped groove; and a modular means which snaps on to said housing means for use in securing said actuator means.

9. The latch assembly of claim 8 wherein said housing means includes a stopper assembly, said stopper assembly having a groove running vertically on an inside wall thereof.

10. The latch assembly of claim 9 further including a molding bumper, said molding bumper having a rectangular shape arid at least one inwardly descending edge.

11. The latch assembly of claim 10 wherein said molding bumper is made of a urethane material.

12. The latch assembly of claim 8 wherein said housing means includes a circumferential orifice.

13. The latch assembly of claim 8 wherein said camming surface, includes a generally L-shaped cross section, said camming surface having an orifice and a circumferential knob on one end thereof.

14. The latch assembly of claim 13 wherein said camming surface knob is placed within the C-shaped groove of said actuator means.

* * * * *